US012312983B2

(12) United States Patent
Wu

(10) Patent No.: US 12,312,983 B2
(45) Date of Patent: May 27, 2025

(54) OIL TANK CAP

(71) Applicant: COPLUS INC., Tainan (TW)

(72) Inventor: Po-Hua Wu, Tainan (TW)

(73) Assignee: Coplus Inc., Tainan (TW)

( * ) Notice: Subject to any disclaimer, the term of this patent is extended or adjusted under 35 U.S.C. 154(b) by 85 days.

(21) Appl. No.: 18/503,641

(22) Filed: Nov. 7, 2023

(65) Prior Publication Data

US 2024/0151169 A1 May 9, 2024

(30) Foreign Application Priority Data

Nov. 8, 2022 (TW) ..... 111212217

(51) Int. Cl.

| | |
|---|---|
| ***F01M 11/04*** | (2006.01) |
| ***B65D 41/02*** | (2006.01) |
| ***B65D 51/16*** | (2006.01) |
| ***B65D 53/02*** | (2006.01) |

(52) U.S. Cl.

CPC ..... *F01M 11/04* (2013.01); *B65D 41/02* (2013.01); *B65D 51/1644* (2013.01); *B65D 53/02* (2013.01); *B65D 2205/02* (2013.01); *B65D 2251/205* (2013.01); *F01M 2011/0491* (2013.01)

(58) Field of Classification Search

CPC ..... B60K 15/0406; B60K 2015/0438; B60K 15/05; B60K 2015/0451; F01M 11/04; F01M 2011/0491; B65D 41/02; B65D 51/1644; B65D 53/02; B65D 2205/02; B65D 2251/205

See application file for complete search history.

(56) References Cited

U.S. PATENT DOCUMENTS

| | | | | |
|---|---|---|---|---|
| 2,077,721 A * | 4/1937 | Sinko | B60K 15/0406 220/302 |
| 4,059,033 A * | 11/1977 | Johnson | B67B 7/18 81/125 |
| 4,480,470 A * | 11/1984 | Tussing | G01F 23/04 33/721 |
| 6,213,331 B1 * | 4/2001 | Morgan | B60K 15/0406 220/295 |
| 2019/0152313 A1 * | 5/2019 | Koch | B60K 15/03504 |

* cited by examiner

*Primary Examiner* — Shawn M Braden

(74) *Attorney, Agent, or Firm* — Burris Law, PLLC

(57) ABSTRACT

An oil tank cap is adapted to be removably engaged with an oil inlet of an oil tank. The oil tank cap includes a cap body that is one-piece, that is plastic, and that includes a cap portion adapted to be disposed outside the oil inlet, and a plug portion extending from the cap portion along a central axis of the cap body and adapted to extend into the oil inlet. The plug portion has a surrounding surface that surrounds the central axis of the cap body, a base surface, an accommodating slot extending through the surrounding surface, and at least one recess formed in the base surface, extending towards the cap portion, and being isolated from the accommodating slot. The oil tank cap further includes a spring strip that has a positioning portion disposed in the accommodating slot, and two abutting portions extending outwardly of the accommodating slot.

18 Claims, 4 Drawing Sheets

OIL TANK CAP

CROSS-REFERENCE TO RELATED APPLICATION

This application claims priority to Taiwanese Utility Model Patent Application No. 111212217, filed on Nov. 8, 2022, the entire disclosure of which is incorporated by reference herein.

FIELD

The disclosure relates to an oil tank cap, and more particularly to an oil tank cap for motorcycles.

BACKGROUND

A conventional oil tank cap is adapted to be removably engaged with an oil inlet of an oil tank for preventing a fuel or a lubricant from leaking, and keeping impurities from the external environment from getting into the oil tank. The conventional oil tank cap includes a cap body and other structures. The cap body includes a cap, a plug disposed at a bottom center of the cap and adapted to extend into the oil inlet, and a plurality of rivets that connect the cap to the plug. The cap body of the conventional oil tank cap is composed of a plurality of components and the manufacturing cost thereof is significant. Furthermore, when the cap body is hit by a force, stress is gathered around the riveted junction, which may break the rivets or disconnect the cap from the plug, thereby causing the fuel or the lubricant to leak. Hence, there is room for improvement on the conventional oil tank cap.

SUMMARY

Therefore, an object of the disclosure is to provide an oil tank cap that can alleviate at least one of the drawbacks of the prior art.

According to the disclosure, the oil tank cap is adapted to be removably engaged with an oil inlet of an oil tank. The oil tank cap includes a cap body and a spring strip. The cap body is one-piece and plastic, and includes a cap portion and a plug portion. The cap portion is adapted to be disposed outside the oil inlet, and the plug portion extends from the cap portion along a central axis of the cap body and is adapted to extend into the oil inlet. The plug portion has a surrounding surface, a base surface, an accommodating slot, and at least one recess. The surrounding surface surrounds the central axis of the cap body. The base surface is connected to an end of the surrounding surface opposite to the cap portion. The accommodating slot extends through the surrounding surface and intersects with the central axis of the cap body. The least one recess is formed in the base surface, extends towards the cap portion, and is isolated from the accommodating slot. The spring strip has a positioning portion and two abutting portions. The positioning portion is disposed in the accommodating slot. The two abutting portions extend respectively from opposite ends of the positioning portion and extend outwardly of the accommodating slot.

BRIEF DESCRIPTION OF THE DRAWINGS

Other features and advantages of the disclosure will become apparent in the following detailed description of the embodiment(s) with reference to the accompanying drawings. It is noted that various features may not be drawn to scale.

DETAILED DESCRIPTION

Figure 1:
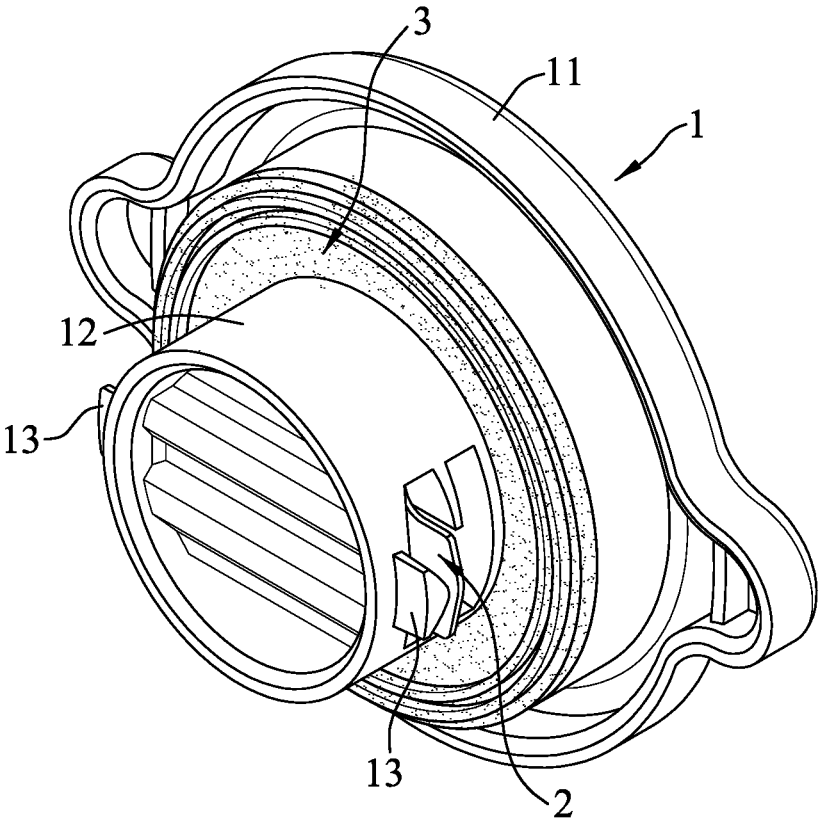
FIG. 1 is a perspective view illustrating an embodiment of an oil tank cap according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Figure 2:
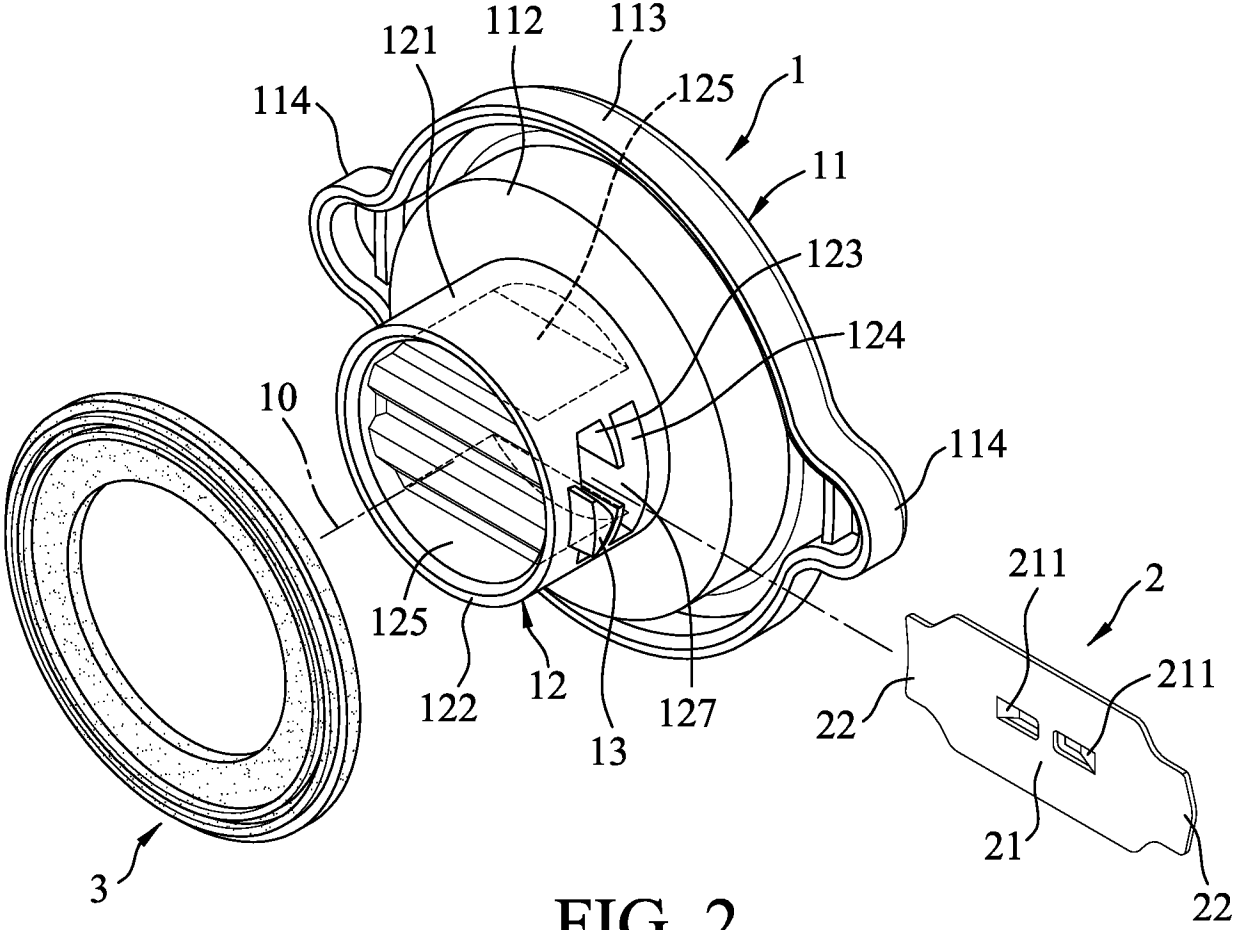
FIG. 2 is an exploded perspective view of the embodiment.
Figure 3:
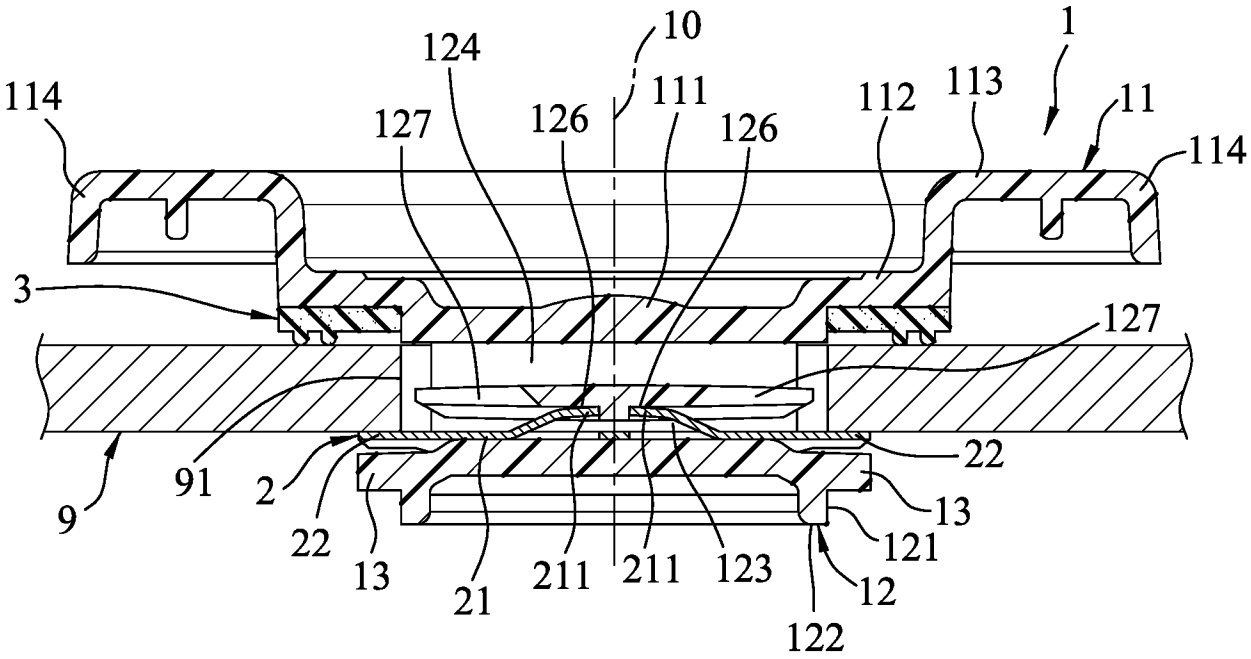
FIG. 3 is a fragmentary sectional view illustrating the embodiment engaged with an oil tank.

Referring to FIGS. 1 to 3, an embodiment of the oil tank cap according to the disclosure is adapted to be removably engaged with an oil tank 9 for vehicles such as motorcycles. The oil tank 9 has an oil inlet 91 for adding fuel or lubricant, and the oil tank cap is adapted to prevent the fuel or the lubricant from leaking, and to prevent impurities from the external environment from entering the oil inlet 91. The oil tank cap includes a cap body 1, a spring strip 2, and a washer 3.

Figure 4:
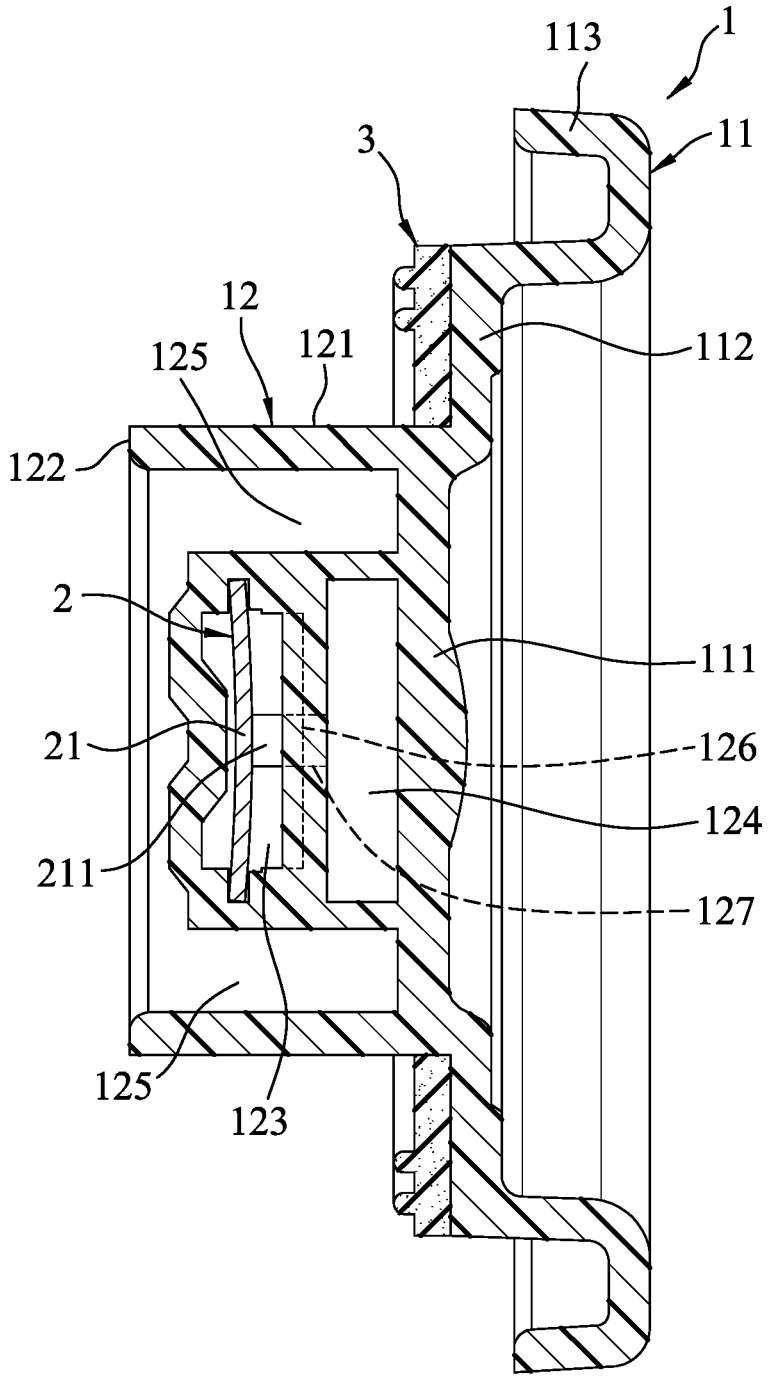
FIG. 4 is a sectional view of the embodiment.

Referring to FIGS. 2, 3, and 4, the cap body 1 is one-piece and plastic, and includes a cap portion 11 adapted to be disposed outside the oil inlet 91, and a plug portion 12 extending from the cap portion 11 along a central axis 10 of the cap body 1 and adapted to extend into the oil inlet 91. The cap body 1 further has two limiting portions 13, and each of the limiting portions 13 extends from the plug portion 12 and below the oil inlet 91.

The cap portion 11 has a base circle wall 111 integrally connected to the plug portion 12, a shoulder wall 112 extending outwardly from a periphery of the base circle wall 111, a grip wall 113 connected to a periphery of the shoulder wall 112 and having an annular groove that is adapted to open towards the oil tank 9, and two ear walls 114 extending outwardly from the grip wall 113 and being spaced apart from each other for providing a firmer grip. The base circle wall 111, the shoulder wall 112, and the grip wall 113 form a stepped structure. In other embodiments, a shape of the ear walls 114 may be different.

The plug portion 12 has a surrounding surface 121 that surrounds the central axis 10 of the cap body 1, a base surface 122 that is connected to an end of the surrounding surface 121 opposite to the cap portion 11, an accommodating slot 123 that extends through the surrounding surface 121 and that intersects with the central axis 10 of the cap body 1, and an extending slot 124 that extends through the surrounding surface 121, that intersects with the central axis of the cap body 1, that is disposed between the accommodating slot 123 and the cap portion 11, and that is parallel to the accommodating slot 123. The plug portion 12 further has at least one recess 125 formed in the base surface 122, extending towards the cap portion 11, and isolated from the accommodating slot 123 and the extending slot 124. In this embodiment, the at least one recess 125 includes two recesses 125 disposed respectively at opposite sides of the accommodating slot 123 and being spaced apart from each other. The plug portion 12 further includes two retaining spaces 126 and two open slots 127. The retaining spaces 126 are in spatial communication with the accommodating slot 123 and are disposed between the extending slot 124 and the accommodating slot 123. Each of the open slots 127 interconnects the extending slot 124 and a respective one of the retaining spaces 126, and is disposed for facilitating assembly of the spring strip 2 and the cap body 1. Specifically, by virtue of the recesses 125 and the extending slot 124, the amount of materials used for the cap body 1 and the manufacturing cost of the cap body 1 may be lowered. By reducing the thickness of the material between the accommodating slot 123 and the base circle wall 111, the extending slot 124 further has the advantage of keeping the base circle wall 111 from collapsing and shrinking caused by thermal expansion during the manufacturing process. By reducing the thickness of the material among the surrounding surface 121, the accommodating slot 123 and the extending slot 124, the recesses 125 have the advantages of preventing the structure of the plug portion 12 from collapsing and shrinking due to thermal expansion during manufacturing, and avoiding uneven surfaces that often form in thick sections of plastic products from forming in the structure of the plug portion 12. It should be noted that the amount of the at least one recess 125 in this embodiment is not limited to two, and may vary as needed in other embodiments.

Each of the limiting portions 13 of the cap body 1 is disposed between the base surface 122 and a respective one of opposite ends of the accommodating slot 123, and has a triangular cross section.

The spring strip 2 is made of a metal material, and has a positioning portion 21 disposed in the accommodating slot 123, and two abutting portions 22 extending respectively from opposite ends of the positioning portion 21 and extending outwardly of the accommodating slot 123. The positioning portion 21 has two protrusions 211 that engages respectively with the retaining spaces 126. The two open slots 127 facilitate the assembly of the spring strip 2 and the cap body 1 by respectively guiding the protrusions 211 to the retaining spaces 126. Each of the limiting portions 13 is aligned with a respective one of the abutting portions 22 of the spring strip 2 for limiting resilient deformation of the abutting portions 22. Specifically, if the cap body 1 or an area surrounding the oil inlet 91 is hit by an external force, the external force may cause the spring strip 2 to resiliently deform and cause the abutting portions 22 to respectively abut against the limiting portions 13, and the limiting portions 13 serve as a support to prevent excessive deformation of the spring strip 2. Each of the abutting portions 22 of the spring strip 2 has an inverted V shape and complements each of the limiting portions 13. The shape of the abutting portions 22 may be different in other embodiments.

The washer 3 has a flexible annular body that is sleeved on the plug portion 12 and that is adapted to tightly seal a space between the oil tank 9 and the cap portion 11 to prevent the fuel or the lubricant in the oil tank 9 from leaking.

In conclusion, the one-piece configuration of the cap body may strengthen the structure and increase safety, and the at least one recess 125 may greatly reduce the materials and cost needed for manufacturing while maintaining the structural strength, prevent shrinking and collapsing of the structure of the oil tank cap, and avoid formation of uneven surfaces during manufacturing. Hence, the objective of the disclosure is achieved.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is(are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. An oil tank cap adapted to be removably engaged with an oil inlet of an oil tank, said oil tank cap comprising:

a cap body that is one-piece, that is plastic, and that includes a cap portion adapted to be disposed outside the oil inlet, and a plug portion extending from said cap portion along a central axis of said cap body and adapted to extend into the oil inlet, said plug portion having a surrounding surface that surrounds the central axis of said cap body, a base surface that is connected to an end of said surrounding surface opposite to said cap portion, an accommodating slot that extends through said surrounding surface and that intersects with the central axis of said cap body, and at least one recess that is formed in said base surface, that extends towards said cap portion, and that is isolated from said accommodating slot; and a spring strip that has a positioning portion disposed in said accommodating slot, and two abutting portions extending respectively from opposite ends of said positioning portion and extending outwardly of said accommodating slot.

2. The oil tank cap as claimed in claim 1, wherein said at least one recess includes two recesses disposed respectively at opposite sides of said accommodating slot and being spaced apart from each other.

3. The oil tank cap as claimed in claim 2, wherein said plug portion further has an extending slot that extends through said surrounding surface, that intersects with the central axis of said cap body, that is disposed between said accommodating slot and said cap portion, and that is parallel to said accommodating slot.

4. The oil tank cap as claimed in claim 3, wherein:

said plug portion further has two retaining spaces that are in spatial communication with said accommodating slot and that are disposed between said extending slot and said accommodating slot; and said positioning portion of said spring strip has two protrusions engaging respectively with said retaining spaces.

5. The oil tank cap as claimed in claim 4, wherein said plug portion further has two open slots, each of said open slots interconnecting said extending slot and a respective one of said retaining spaces, and disposed for facilitating assembly of said spring strip and said cap body.

6. The oil tank cap as claimed in claim 5, wherein said cap body further has two limiting portions, each of said limiting portions extending from said plug portion, disposed between said base surface and a respective one of opposite ends of said accommodating slot, and being aligned with a respective one of said abutting portions of said spring strip for limiting resilient deformation of said abutting portions.

7. The oil tank cap as claimed in claim 6, wherein:

each of said limiting portions of said upper cap body has a triangular cross section; and each of said abutting portions of said spring strip has an inverted V shape and complements each of said limiting portions.

8. The oil tank cap as claimed in claim 4, wherein said cap body further has two limiting portions, each of said limiting portions extending from said plug portion, disposed between said base surface and a respective one of opposite ends of said accommodating slot, and being aligned with a respective one of said abutting portions of said spring strip for limiting resilient deformation of said abutting portions.

9. The oil tank cap as claimed in claim 8, wherein:

each of said limiting portions of said upper cap body has a triangular cross section; and each of said abutting portions of said spring strip has an inverted V shape and complements each of said limiting portions.

10. The oil tank cap as claimed in claim 3, wherein said cap body further has two limiting portions, each of said limiting portions extending from said plug portion, disposed between said base surface and a respective one of opposite ends of said accommodating slot, and being aligned with a respective one of said abutting portions of said spring strip for limiting resilient deformation of said abutting portions.

11. The oil tank cap as claimed in claim 10, wherein:

each of said limiting portions of said upper cap body has a triangular cross section; and each of said abutting portions of said spring strip has an inverted V shape and complements each of said limiting portions.

12. The oil tank cap as claimed in claim 2, wherein said cap body further has two limiting portions, each of said limiting portions extending from said plug portion, disposed between said base surface and a respective one of opposite ends of said accommodating slot, and being aligned with a respective one of said abutting portions of said spring strip for limiting resilient deformation of said abutting portions.

13. The oil tank cap as claimed in claim 12, wherein:

each of said limiting portions of said upper cap body has a triangular cross section; and each of said abutting portions of said spring strip has an inverted V shape and complements each of said limiting portions.

14. The oil tank cap as claimed in claim 1, wherein said cap body further has two limiting portions, each of said limiting portions extending from said plug portion, disposed between said base surface and a respective one of opposite ends of said accommodating slot, and being aligned with a respective one of said abutting portions of said spring strip for limiting resilient deformation of said abutting portions.

15. The oil tank cap as claimed in claim 14, wherein:

each of said limiting portions of said upper cap body has a triangular cross section; and each of said abutting portions of said spring strip has an inverted V shape and complements each of said limiting portions.

16. The oil tank cap as claimed in claim 1, wherein said cap portion has:

a base circle wall integrally connected to said plug portion;

a shoulder wall extending outwardly from a periphery of said base circle wall; and a grip wall connected to a periphery of said shoulder wall, and having an annular groove that is adapted to open towards the oil tank.

17. The oil tank cap as claimed in claim 16, wherein said cap portion further has two ear walls extending outwardly from said grip wall and being spaced apart from each other.

18. The oil tank cap as claimed in claim 1, further comprising a washer that is sleeved on said plug portion and that is adapted to tightly seal a space between the oil tank and said cap portion.

* * * * *